United States Patent [19]

Shelden et al.

[11] 3,994,100

[45] Nov. 30, 1976

[54] MULTI-STATION GRINDING MACHINE WITH PIVOTED GRINDING ELEMENTS

[75] Inventors: Richard S. Shelden, Cherry Valley, Ill.; Robert L. Schaller, Camillus; Donald L. Towne, North Syracuse, both of N.Y.

[73] Assignee: Sundstrand Syracuse, Inc., Syracuse, N.Y.

[22] Filed: Jan. 16, 1976

[21] Appl. No.: 649,857

Related U.S. Application Data

[63] Continuation of Ser. No. 369,787, June 14, 1973, abandoned.

[52] U.S. Cl. ..... 51/145 T; 51/147

[51] Int. Cl.[2] ..... B24B 21/04; B24B 21/18

[58] Field of Search ..... 51/135 R, 145 R, 145 T, 51/147, 99, 108 R, 126, 134

[56] References Cited

UNITED STATES PATENTS

| | | | |
|---|---|---|---|
| 2,442,042 | 5/1948 | Hamilton | 51/99 |
| 2,612,007 | 9/1952 | Bell | 51/145 T |
| 2,636,321 | 4/1953 | Wilson | 51/108 R |
| 2,723,598 | 11/1955 | Mann | 51/99 X |
| 2,818,058 | 12/1957 | Zuzelo | 51/99 X |
| 3,382,622 | 5/1968 | Dunn | 51/115 |
| 3,731,911 | 5/1973 | Röder | 83/56 X |
| 3,816,998 | 6/1974 | Griuna | 51/145 T |

OTHER PUBLICATIONS

*Timesavers Speedbelt Grinder*, Publication Advertising Model 118, Aug. 1970.

*Primary Examiner*—Al Lawrence Smith
*Assistant Examiner*—Nicholas P. Godici
*Attorney, Agent, or Firm*—Wegner, Stellman, McCord, Wiles & Wood

[57] ABSTRACT

A multi-station grinding machine having an index table carrying a plurality of work tables rotatable with respect thereto with means for oscillating the index table while simultaneously rotating a work table whereby a workpiece at a grinding station is caused to have compound movements relative to a grinding element at the grinding station. The structure at the grinding station includes a column carrying a grinding element with the column being mounted for pivotal movement to move the grinding element toward and away from the work table with the column being out of balance, whereby the weight thereof normally urges the column in a direction to move the grinding element away from the work table and with jack mechanism operable to move the column through infeed and fast infeed movements to advance the grinding element relative to the work table. The foregoing structure has hydraulic circuitry for supplying the hydraulic motors for the index table and work tables and the operating cylinders for the jack mechanism whereby a grinding cycle may be performed at a plurality of stations with the index table oscillating and the work tables rotating while the grinding elements are being advanced and with an additional work table being at a load-unload station to exchange an unfinished workpiece for a finished workpiece while grinding is occurring at the other stations.

14 Claims, 5 Drawing Figures

28
292
34
290
294
296
306
298
300
302
304
308
308
310
310
312
314
316
316
316
316
316
318
320
322
324
326

MULTI-STATION GRINDING MACHINE WITH PIVOTED GRINDING ELEMENTS

This application is a continuation of application Ser. No. 369,787 filed June 14, 1973, now abandoned.

BACKGROUND OF THE INVENTION

This invention pertains to grinding machines having structure providing for simultaneous grinding at a plurality of stations for rough and finish grinding, with simultaneous loading and unloading of workpieces at an additional station and with operating mechanism whereby the workpiece is both rotated and moved in an oscillatory path with respect to a grinding element to provide improved finish and flatness for the workpiece, along with improved life of a grinding element, such as a belt.

Multi-station grinding machines of the belt type now used in production conventionally have a table supporting a workpiece with the table movable relative to the grinding element. Such a structure does not perform satisfactorily when there are plural grinding stations, since it is difficult to obtain parallelism between the grinding element and the workpieces at the respective grinding stations.

The Fruth U.S. Pat. No. 2,405,417, discloses a grinding machine wherein an index table carries a series of rotatably mounted work tables and with a grinding element mounted for adjustment relative to the work tables. In this patent, the drive for the rotatable work tables is inter-geared with the drive for the index table, whereby the work tables are not free to continuously rotate in a single direction while an index table oscillates and, in fact, there is no disclosure in this patent of oscillating the index table. Additionally, the structure for adjusting the grinding element does not provide for canting of the grinding element to provide parallelism with the work table.

SUMMARY OF THE INVENTION

It is the principle object of the invention to provide a new and improved grinding machine. More specifically, it is an object of the invention to provide a multi-station grinding machine including plural work tables which may be simultaneously operated to achieve rough and finish grinding, actuating mechanism for the tables whereby compound movement of the workpiece relaive to the grinding means may be achieved, structure for adjusting the attitude of the grinding device relative to the work tables to provide parallelism between the grinding element and the work, and a unique system normally biasing the grinding element away from the work whereby malfunctions will not result in the destruction of, or damage to, the work.

The exemplary embodiment of the invention achieves the foregoing objects in a structure including an index table rotatably mounted on a base and, in turn, mounting a plurality of spaced work tables. The work tables are rotatably mounted on the index table for rotation thereon and for rotation relative to the base between plural grinding stations including a coarse grinding station and a fine grinding station.

Means are provided for rotating the work tables on the index table at the grinding stations along with means for oscillating the index table so that the work tables are also oscillated at the grinding stations. As a result, there is relative compound movement between grinding elements at the grinding stations and the work to provide a more efficient grinding operation.

In the preferred embodiment, the work tables are rotated by a hydraulic motor in connection with a hydraulic control circuit including a valve which is operable to cause the hydraulic motor to reverse direction on alternate grinding cycles to minimize wear. The index table is also driven by a hydraulic motor and to achieve oscillation of the same to provide compound grinding movement, trip dogs are mounted on the table to operate conjointly with limit switches which control the valving circuit for the hydraulic motor driving the index table to cause oscillation of the same.

In the preferred embodiment, the grinding means are in the form of belt grinders, although disc grinders could be used in lieu thereof, and are mounted on columns which, in turn, are mounted for pivotal movement to direct the grinding element towards or away from the work table disposed therebeneath. The pivots mounting the respective columns are located such that the weight of the columns will normally cause the same to pivot in a direction to move the grinding element away from the work.

In the preferred embodiment, each pivot for a column is defined by a pair of pivot shafts with one of the pivot shafts being eccentric. An adjusting means is provided for rotating the eccentric pivot shaft relative to the column so that the column may be canted as desired to change its attitude relative to the work table and workpiece therebeneath. Through such an adjustment, the grinding element may be brought into parallelism with the workpiece on the work table.

In addition to the aforementioned gravity biasing of each column, in a preferred embodiment, a hydraulic cylinder connected to each column is provided to normally bias the same about its pivot for movement in the same direction as that instigated by gravity. The hydraulic cylinder is normally continually pressurized to cause said biasing so that in the case of a malfunction, the grinding element will be immediately removed from the work.

In order to drive the grinding element into the work, a jack is connected to the column in such a way as to be in bucking relation with the previously-mentioned hydraulic cylinder. The jack includes a vertical screw and a rack and gear drive for rotating the screw. A hydraulic cylinder is employed for moving the rack and a hydraulic circuit controls the cylinder and includes a valve operable to advance the rack in either a first rate or a second rate to respectively cause rapid infeed of the grinding element towad the work table or fine infeed of the grinding element.

The jack also includes a spline connection of the rack and gear drive to the vertical screw and includes a nut coacting with the vertical screw. A means for rotating the nut while the vertical screw is held against rotation by the rack and gear drive is also provided so that the vertical position of the vertical screw may be adjusted manually.

A grinding machine made according to the invention includes a variety of features including controls for rotating the work table at two rates of speed, one for normal grinding, and a second, more rapid rate, without infeed of the grinding element to achieve "spark-out". Also provided is a safety feature which senses malfunction of the grinding element as, for example, the breakage of a grinding belt if a belt grinding element is employed.

Other objects and advantages of the invention will become apparent from the following specification taken in conjunction with the accompanying drawings.

DESCRIPTION OF THE PREFERRED EMBODIMENT

Figure 1:
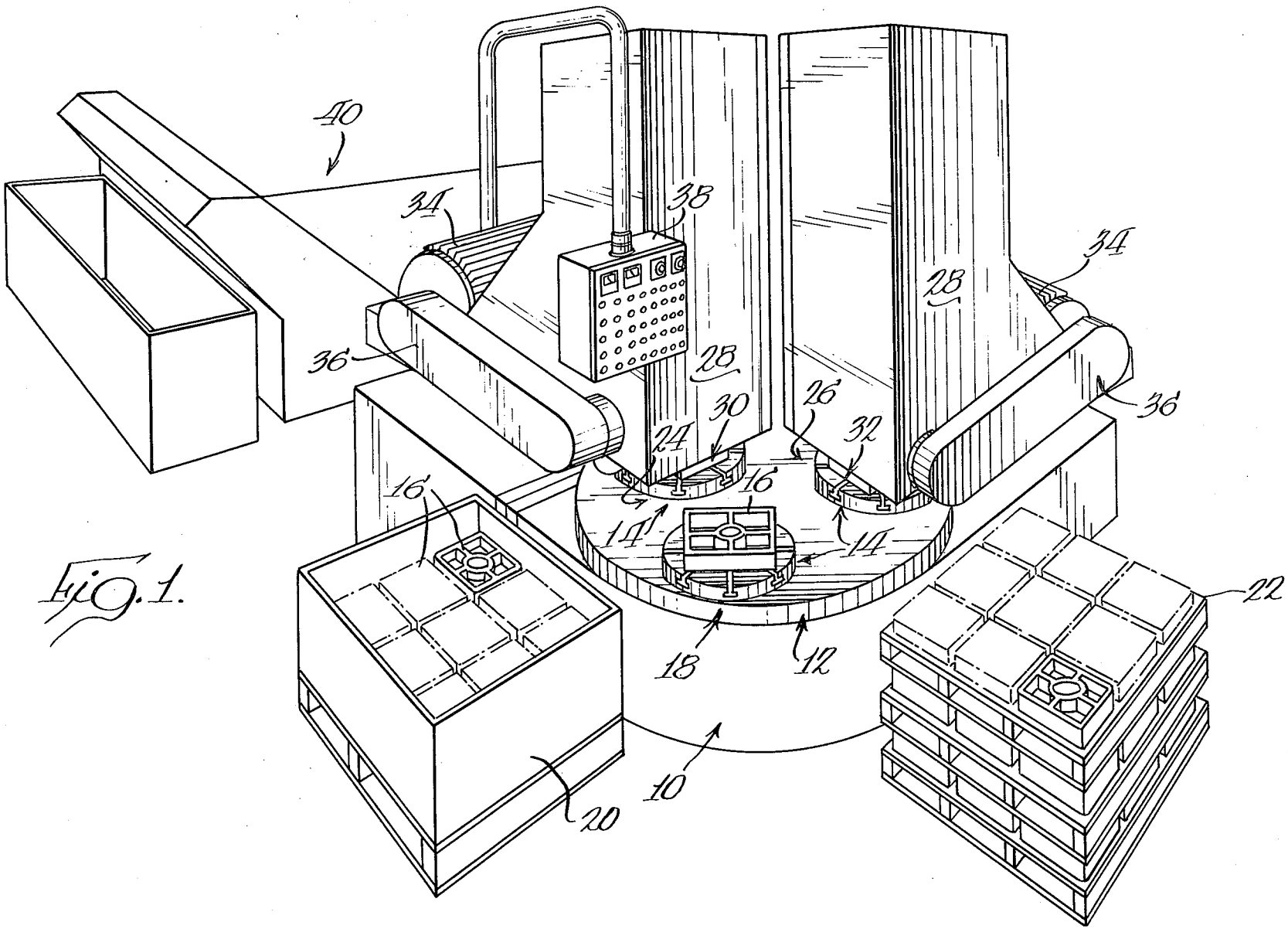
FIG. 1 is a perspective view of a grinding machine made according to the invention.

An exemplary embodiment of a grinding machine made according to the invention is illustrated in FIG. 1 and is seen to include a base, generally designated 10, which rotatably mounts an index table, generally designated 12. The index table 12, in turn, mounts a plurality of three work tables, each generally designated 14, upon which a workpiece 16 may be located.

One of the work tables 14 is located in a load-unload station, generally designated 18, whereat unfinished workpieces 16 may be taken from a bin 20 and placed on the table 14 occupying the load-unload station 18. In addition, finished workpieces 16 may be removed from the table 14 at the load-unload station and be placed on pallets 22 for shipment.

Another of the work table 14 is located at a coarse grinding station, generally designated 24, while the third work piece 14 is located at a fine grinding station, generally designated 26.

At each of the grinding stations 24 and 26, there is located a column, generally designated 28, housing a coarse grinding element, generally designated 30, and a fine grinding element, generally designated 32, respectively.

Each of the columns 28 may mount a rotary motor 34 and associated transmission 36 for driving the associated grinding element. A control panel 38 is located in close proximity to the load-unload station 18 whereat an operator will normally stand while a coolant separator, generally designated 40, may also be provided for separating coolant employed in the grinding operations from metal particles or the like separated from the workpieces 16 during the various grinding operations.

As will be seen, the index table 12 is rotated in a generally clockwise direction, as viewed in FIG. 1, to sequentially advance a work table 14 and a workpiece 16 thereon through the coarse grinding station 24 and the fine grinding station 26 to the load-unload station 18 whereat the workpiece 16 may be placed on one of the pallets 22 and an unfinished workpiece 16 removed from the bin 20 and placed on the work table 14.

By means to be described in greater detail hereinafter, the work tables 14 are rotated on the index table 12 when at either one of the grinding stations 24 and 26. During such a grinding operation, the index table 12 is oscillated about its axis of rotation so that there will be compound relative movement between each workpiece 16 and the associated one of the grinding elements 30 and 32 at the grinding stations 24 and 26.

Figure 2:
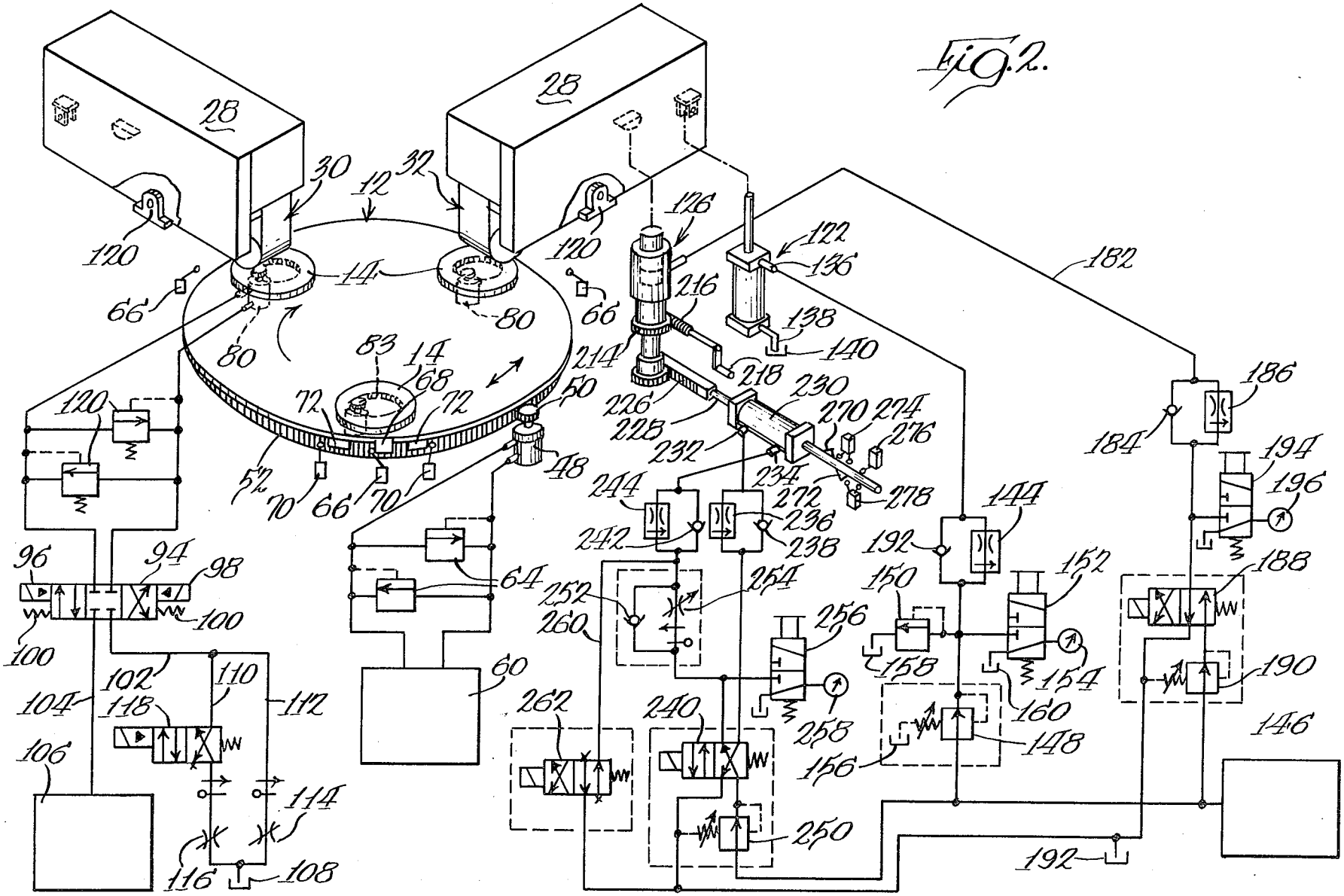
FIG. 2 is a schematic of the grinding machine and various hydraulic controls therefor.
Figure 3:
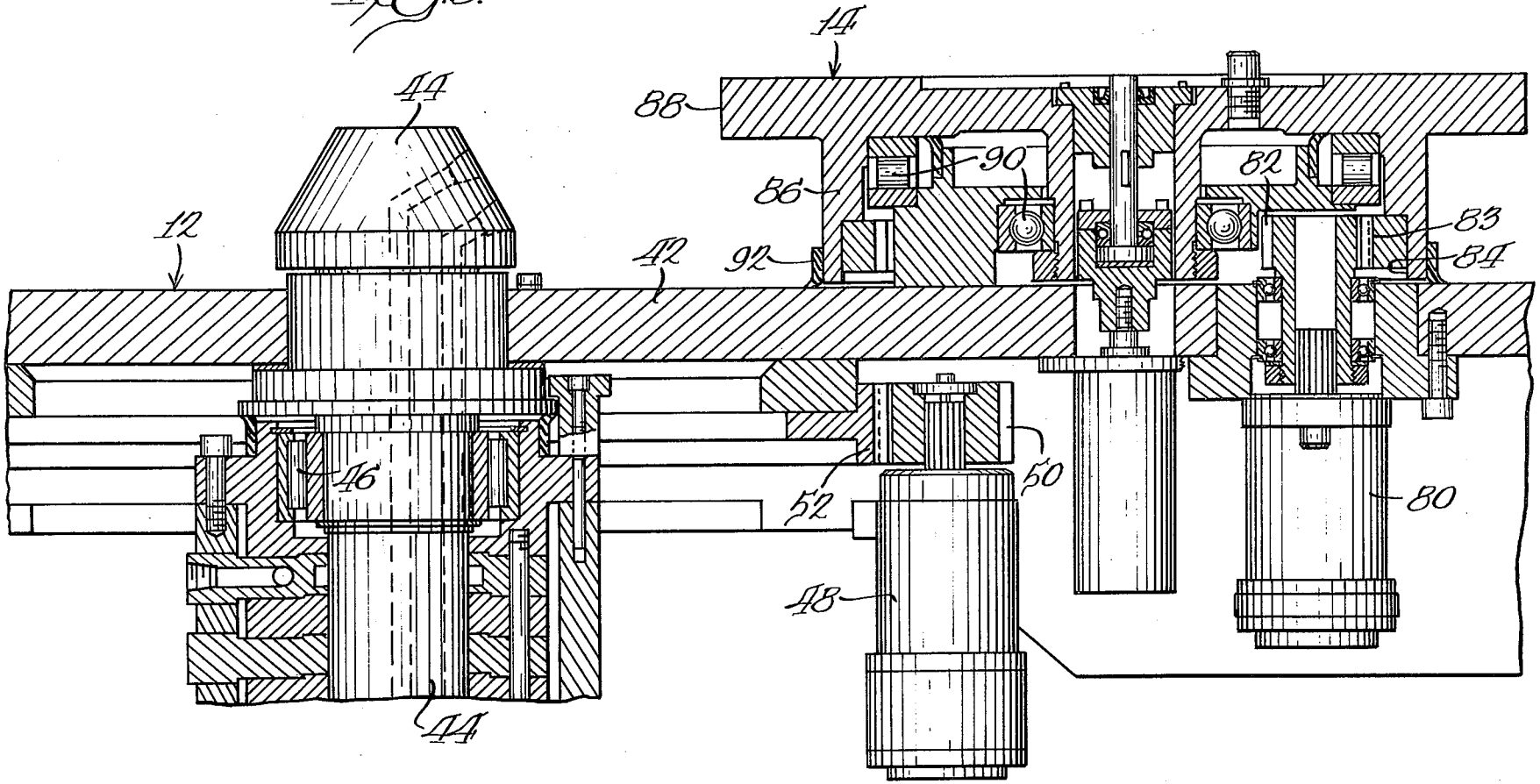
FIG. 3 is a fragmentary vertical section of the index table and a work table of the grinding machine.

With reference now to FIGS. 2 and 3, the index table 12 and control means therefor will be described in greater detail. Referring specifically to FIG. 3, the index table 12 includes a circular plate 42 mounted on a vertically-extending post 44 for rotation about a vertical axis on bearings including bearing 46. Mounted on the base 10 by any suitable means is a hydraulic motor 48 having a spur gear 50 secured to its rotary output shaft. The spur gear 50 is in mesh with a gear 52 which is secured by any suitable means to the underside of the plate 42 with the result that when the hydraulic motor 48 is energized in either direction, the plate 42 will be rotated. Various porting, not numbered, may be included in connection with the post 44 to provide conduits for the flow of hydraulic fluid to hydraulic elements associated with the work tables 14 and for housing electrical conductors in various control circuits.

Turning now to FIG. 2, the hydraulic motor 48 for rotating the index table 12 is seen to be connected by a pair of lines to a pump 60 of the type that is normally employed in hydrostatic transmissions. Conventionally such a pump will include a swash plate, the attitude of which may be varied to reverse direction of fluid flow and to provide an infinitely variable flow rate in either direction of fluid flow. As will be seen, the swash plate may be controlled to direct hydraulic fluid under pressure to the motor 48 to cause the same to drive the index table 12 in either direction. Through suitable electrical circuitry (not shown) the swash plate of the pump 60 is controlled to cause the index table 12 to rotate to deliver any selected one of the work tables 14 to a given grinding station. Once a table 14 and a workpiece thereon is at the grinding station, the swash plate of the pump 60 may then be oscillated to both sides of its neutral position to cause oscillation of the index table. Pressure operated relieve valves 64 are inclined in the circuit for the purpose of automatically establishing a bypass in the event of excessive pressure buildup in the lines caused by an excessive load on the motor 48 as, for example, when rotation or oscillation of the index table 12 is abnormally impeded.

Typically, such control circuitry will include actuators associated with the tape 12 for sensing the position thereof. For example, at each station there is provided a "home" limit switch 66 which is adapted to be tripped by a home trip dog 68. A single one of the trip dogs 68 is provided and the same will trip any one of the switches 66 depending upon the position of relative rotation of the index table 12.

For the purpose of causing oscillation of the table 12, a pair of spaced limit switches 70 are provided at the load-unload station 18. The index table 12 further mounts spaced trip dogs 72 located to trip the limit switches 70. Only two trip dogs 72 are illustrated, but it is to be understood that the two such dogs are mounted adjacent each one of the work tables 14 for a total of six in all. The arrangement is such that during the oscillation phase, as the index table 12 is rotated in a clockwise direction, the leftmost one of the trip dogs 72 will trip the leftmost one of the limit switches 70 to cause the pump 60 to reverse its condition, thereby causing reversal of the direction of rotation of the hydraulic motor 48. Such a direction reversal will be maintained until the rightmost one of the trip dogs 72 trips the rightmost one of the limit switches 70. Thus, in turn, will cause the reversing valve 60 to revert to its original condition, again causing a reversal of the direction of the index table 12. Such oscillation will take place until the grinding operation has been completed.

Returning to FIG. 3, the nature of each of the work tables 14 and their controls will be described in greater detail. Since each is identical to the other, only one will be described. A hydraulic motor 80 is secured to the underside of the plate 42 defining the table 12 and has a spur gear 82 secured to its rotary output shaft. The spur gear 82 is, in turn, in mesh with an internal ring gear 83 which is secured by any suitable means in a peripheral recess 84 in a downwardly-directed sleeve 86 forming a portion of the work table 14. At the upper end of the sleeve 86, the work table 14 includes a radially outwardly extending lip 80, the upper surface of which defines a work-receiving surface. Any suitable means may be provided thereon to assist in orienting and holding a workpiece 16 thereon.

Bearings 90 are employed to mount the work table 14 for rotation on the index table 12 for rotation about a vertical axis. Lastly, a depending sleeve 92 of flexible material may be secured to the lower end of the sleeve 86 to engage the upper surface of the plate 42 to preclude coolant and metal chips from entering the space between the work table 14 and the index table 12.

Referring now to FIG. 2, the hydraulic motor 80 for driving the work table 14 is connected by a pair of lines to a double-acting, self-centering, solenoid-operated, four-way valve 94. That is, the valve 94 includes a pair of solenoid-operators 96 and 98 and centering springs 100 such that the same can assume any one of three different conditions. In one condition, with neither of the solenoids 96 and 98 energized, the springs 100 will center the valve spool to preclude the flow of fluid. In another condition, with one of the solenoids 96 and 98 energized, a tank line 102 and a pressurized line 104 from a source 106 will be in fluid communication with the motor 80 to cause the same to rotate in one direction. In the last condition, the source 106 and the tank line 102 will both be in fluid communication with the motor, but in a reversed relation from the prior condition, with the result that the motor 80 will be driven in the opposite direction.

The tank line 102 is ultimately connected to a tank 108 via parallel branches 110 and 112. Both branches 110 and 112 include adjustable orifices 114 and 116, while the branch 110 further includes a solenoid-operated valve 118. The arrangement is such that when the solenoid operator for the valve 118 has caused the same to open, fluid from the motor 80 may pass through both branches 110 and 112 to the tank 108 while, when the valve 118 is closed, fluid may pass only through the branch 112. Because of the presence of the adjustable orifices 114 and 116, it will be appreciated that when the valve 118 is closed, there will be a higher back pressure in the tank line 102, with the result that the motor 80 will rotate at a much lower rate of speed than if the valve 118 were open and fluid was permitted to flow through both branches 110 and 112.

Finally, pressure responsive relief valves 120 are provided in the circuit, as indicated, for the purpose of automatically opening and establishing a fluid flow bypass in the event there is an unusual interference with the rotation of the corresponding one of the tables 14 to preclude damage to the equipment.

The foregoing control circuitry for the motor 80 operates as follows. Suitable electric controls are provided for both the valve 94 and the valve 118 to cause their operation to be responsive to the operation of other equipment on the grinding machine, as will be described. Specifically, the control circuitry will include means whereby the valve 94 will be allowed to assume the position illustrated in FIG. 2 when the associated table 14 is at the load-unload station whereat it is unnecessary and undesirable to rotate the table 14. When a given one of the tables 14 has been advanced from the load-unload station to the coarse grinding station, one of the solenoids 96 will be energized to cause rotation of the corresponding table in one direction throughout that grinding operation. Once the grinding operation has been completed, and the table is then advanced to the fine grinding station, the other of the solenoids will be energized to cause the table 14 to rotate in the opposite direction. This minimizes wear on the equipment.

The purpose of the valve 118 is as follows. Normally, the same will be closed so that there will be increased back pressure in the tank line 102 from the motor 80 causing the latter to rotate at a relatively low speed. The table 14 will be rotated at a low rate of speed during that part of a grinding operation when the grinding element is advanced towards the work. However, as is well known, at the completion of a grinding operation, advancement of the grinding element is normally terminated for a "spark-out" operation which achieves the final uniformity in the ground surface. At this time, it is desirable to rotate the table 14 at a more rapid rate of speed, which is enabled by the fact that the grinding element is no longer being advanced into the work. Thus, when the spark-out phase of the grinding operation is reached, the solenoid associated with the value 118 may be energized to cause the same to open, thereby minimizing back pressure in the tank line 102 and allowing the motor 80 to rotate the work table 14 at a more rapid rate of speed, so that the spark-out step will be rapidly completed.

Figure 4:
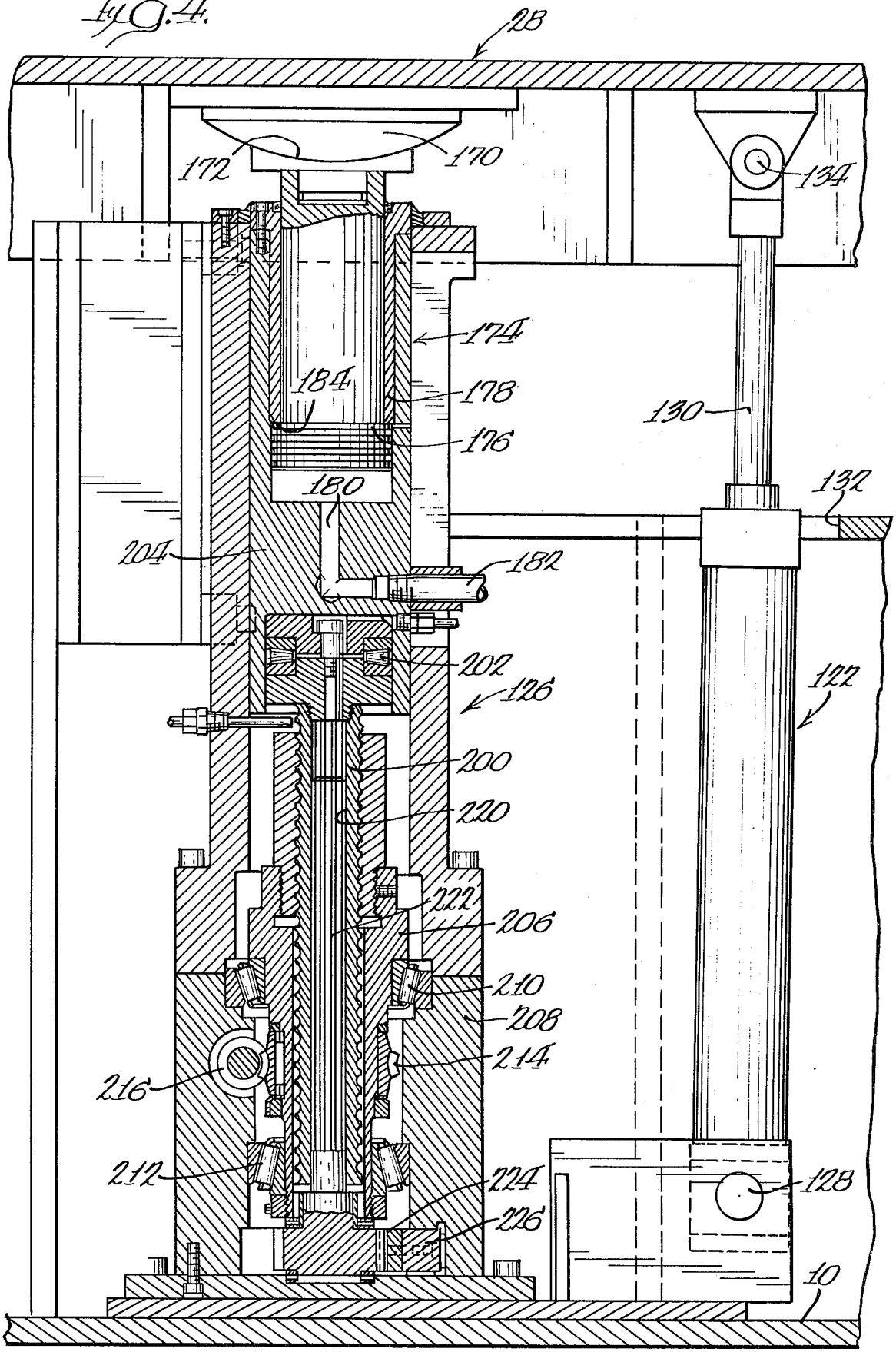
FIG. 4 is a fragmentary vertical section of a portion of a column to mount a grinding element and feed and column retraction elements associated therewith.

With reference now to FIGS. 2 and 4, the construction of each of the columns 28 and the grinding element feeding system will be described in greater detail. Since each is identical to the other, save for the nature of the abrasive employed on the associated grinding element 30 or 32, only one will be described.

Each of the columns 28 is pivotally mounted for rotation about a generally horizontal axis by pillow block bearings 120. The arrangement is such that the associated grinding element may be moved inwardly toward the workpiece on the associated table 14 or moved away therefrom by rotating the column 26 about the foregoing axis. A highly preferred embodiment of the invention requires the location of the pivot axis for each column be sufficiently close to the index table 12 such that the center of gravity of the column is rearwardly thereof to normal bias the column 28 for rotation such that its grinding element will be moved upwardly and away from the workpiece.

Associated with each column to the rear of the associated pivot axis is a hydraulic cylinder, generally designated 122, which, as will be seen, is normally operative to supplement the bias provided by gravity. That is, the hydraulic cylinder 122 is operative to pull downwadly on the rear of the associated column so as to tend to lift the associated grinding element away from the workpiece. Interposed between the pivot axis and the point of connection of the hydraulic cylinder 122 to each column is a jack, generally designated 126. The jack 126 operates in bucking relation to the cylinder 122 so as to drive the column in the opposite direction about its pivotal axis to bring the associated grinding element into contact with the workpiece on the table 14 at that particular station.

Referring now to FIG. 4, the hydraulic cylinder 122 is pivotally connected by a pivot pin 128 to any suitable portion of the base 10, while the rod 130 thereof extends through an opening 132 in the upper portion of the base 10 to be pivotally connected as by a pin 134 to the underside of the associated column 28.

Returning to FIG. 2, the upper end of the cylinder 122 includes a port 136 connected to a control circuit while the lower end of the cylinder 122, for drainage purposes, includes a port 138 connected to a tank 140. More specifically, port 136 is connected to the parallel combination of a check valve 142 and an adjustable orifice 144 to a source 146 of hydraulic fluid under pressure through an adjustable, pressure-regulating valve 148. Also connected in the circuit is a second pressure-responsive valve 150 and a normally closed valve 152 connected to a pressure gauge 154. As a result of the foregoing, fluid under pressure from the source 146 may flow substantially unimpeded through the check valve 142 to the upper end of the hydraulic cylinder 122 to drive the rod 130 downwardly, thereby providing a supplemental biasing force on the column 28 tending to move the grinding element associated therewith away from the work. Leakage about the piston in the cylinder 122 flows to tank 140 through the port 138. The valve 148 may be set to regulate the pressure applied to the upper side of the piston in the cylinder 122 and, when desired pressure is exceeded, it will respond thereto and open to bleed off fluid to tank, as indicated at 156. In the event of an excessive build up in pressure, pressure relief valve 150 will open to bleed off fluid to tank, as indicated at 158. For pressure monitoring purposes as well as to allow accurate regulation of the adjustment of the valve 148, the valve 152 may be operated to connect the downstream side of the valve 148 to the gauge 154. When the valve 152 is permitted to close, any fluid accumulated in the gauge 154 is permitted to flow to tank, as indicated at 160.

In the event of a malfunction in the system, the bias provided by cylinder 122 will be maintained for a predetermined period of time. More particularly, the check valve 142 precludes backflow from the port 136 except through the adjustable orifice 144. The latter may be suitably adjusted so as to regulate the rate of such backflow so as to maintain a suitable biasing pressure for a predetermined period of time.

Returning now to FIG. 4, the jack 126 will be described in detail. The underside of the column 28 includes a spherical bearing surface 170 which is in engagement with a concave bearing surface 172 on the upper end of the extensible member, generally designated 174, of the jack 126. In actuality, the extensible member 174 can itself be extended and, to this end, includes a plunger 176 in a bore 178 near the upper end of the extensible member 174. The upper end of the plunger 176 drives the concave bearing surface 172 and the lower end of the bore 178 is connected via a port 180 and a fluid line 182 to valving as will be seen. When fluid under pressure is applied through the line 182, as will be normally in the case, plunger 176 is driven upwardly against an annular stop surface 184 which, of course, will drive the grinding element downwardly about the pivot axis of the column 28. On the other hand, when pressure is relieved in the port 180, the downward bias to the column 128 provided by gravity and by cylinder 122 will cause the plunger 176 to move downwardly to about the lower end of the bore 178. The purpose of this construction is to provide a predetermined, relatively large increment of movement of the grinding element away from the workpiece during system malfunction by relieving the pressure applied to the port 180.

Turning to FIG. 2, the line 182 is seen to be connected through the parallel combination of a check valve 184 and an adjustable orifice 186 to a solenoid-operated valve 188. The source 146 communicates through an adjustable pressure regulating valve 190 with the valve 188 while a second port of the valve 188 is connected to tank, as at 192.

Included in the circuit is a valve 194 and associated gauge 196 which operate identically to, and serve the same purpose as, valve 152 and associated gauge 154 described previously.

In normal operation, the solenoid valve 188 will assume a condition such that fluid under pressure as regulated by the valve 190 will be directed through the check valve 184 and the line 182 to extend the plunger 176. In the event of system malfunction, the valve 188 is switched so as to cause the establishment of a fluid path from the line 182 to the tank 192 through the adjustable orifice 186. The latter preferably is adjusted so that relatively rapid movement of the column 28 due to the influence of gravity in the cylinder will take place while preventing extremely rapid movements by restricting fluid flow, which rapid movements could cause damage to the equipment.

Returning now to FIG. 4, the lower end of the extensible element 174 includes an externally-threaded screw 200 which has its upper end connected via bearings 202 to the block 204 in which the bore 178 containing the plunger 176 is located. The bearings permit the screw 200 to be rotated relative to the block 204, while effectively coupling the two for conjoint, reciprocal movement in the vertical direction. Surrounding the screw 200 is a nut structure 206 which is maintained in a fixed horizontal position within a housing 208 for the jack element by bearings 210 and 212, which bearings permit the nut 206 to be rotated. The nut 206 mounts a gear surface 214 in engagement with a worn gear 216 which, in turn, may be connected to a manually operable crank 218, or the like, which is located exteriorly of the housing 208 as best illustrated in FIG. 2.

The screw 200 includes an internal, splined bore 220 which slidably receives a splined, vertically-extending shaft 222. The lower end of the shaft 222 is connected to a spur gear 224 within the housing 208 and serves as a pinion. A rack 226 is in engagement with the pinion defined by the spur gear 224 to define a rack and pinion arrangement. The rack 126 extends exteriorly of the housing 208 and is connected to the rod 228 of a double-acting hydraulic cylinder 230, both shown in FIG. 2.

Initial vertical adjustment of the corresponding grinding element associated with the column may be achieved by appropriately manipulating the crank 216 while feeding of the grinding element toward the work on the table is accomplished through actuation of the double-acting hydraulic cylinder 230. More specifically, when an initial adjustment is to be accomplished, the hydraulic cylinder 230 will be halted and the crank 218 rotated. This, in turn, will cause rotation of the nut 206 within the housing 208. Since the screw 200 is splined to shaft 222, which is held motionless at this time, the screw 200 will be advanced on the shaft 222 in one direction or another, depending upon the direction of rotation of the worm gear 216. Of course, once a desired position of adjustment has been achieved, rotation of the worm gear 216 is terminated.

Infeed of the grinding element toward the workpiece is achieved by moving the rack 226 to the right, as viewed in FIG. 2, through appropriate actuation of the hydraulic cylinder 230, as will be seen. Such movement causes rotation of the pinion defined by the spur gear 224, which results in rotation of the splined shaft 222. Since, at this time, the nut 206 is held motionless, rotation of the screw 200 in one direction will result in the latter being advanced upwardly to cause extension of the extendable element 174 and infeed of the grinding element. On the other hand, outfeed of the grinding element through the use of the cylinder 230 may be achieved by driving the rack 226 in the opposite direction whereupon the reverse action will occur to withdraw the extendable element 174.

Turning specifically to FIG. 2, a control circuit for the sylinder 230 will be described. Cylinder 230 includes a port 232 which is pressurized for infeed purposes and a port 234 which is pressurized for outfeed purposes. The port 232 is connected through the parallel combination of an adjustable orifice 236 and a check valve 238 to a solenoid-operated valve 240. A similar combination of a check valve 242 and an adjustable orifice 244 is provided in connection with the port 232. The respective check valves 238 and 242 are arranged so as to allow fluid under pressure to be directed to the associated ports 232 and 234 without substantial impediment, with the orifices 236 and 244 are arranged to control the rate of return of the rod 228 of the cylinder 230 in generally the same manner as the adjustable orifice 186.

The valve 240 includes inlet ports connected to the tank 192, as well as to the source 146, the latter being through an adjustable, pressure regulating valve 250 which operates in the same manner as the pressure regulating valve 190. In addition to the outlet port extending to the adjustable orifice 236 and check valve 238, the valve 240 includes an outlet port extending to the parallel combination of a check valve 252 and an adjustable orifice 254 as well as to a valve 256 and associated gauge 258, the valve 256 and gauge 258 serve the same function as the valve 152 and gauge 154.

The valve and orifice 252 and 254 are connected to the valve and orifice 242 and 244 and, at their junction, a line 260 is taken to solenoid-operated valve 262 which is returned to tank 192.

Operation of the just-described control circuit is as follows. When the valve 240 is in the condition illustrated in FIG. 2, fluid under pressure will be directed through the check valves 252 and 242 to the port 234 to cause retraction of the extendable element of the jack 126 to elevate the grinding element and move the same away from the work. At this time, the rate of movement of the rod 228 of the cylinder 230 will be regulated by the back pressure provided by the orifice 236.

When there is to be infeed of the grinding element toward the work, the above-described control system provides for a rapid infeed as well as a fine infeed. Rapid infeed is provided to bring the grinding element into close adjacency to the workpiece on the table, at which time the mode of operation is switched to fine infeed for the actual grinding operation. To accomplish this, the valve 240 is energized so that fluid under pressure from the source 146 is directed into the port 232 while fluid from the port 234 may pass to the tank 192 through the orifice 244 and/or the orifice 254, depending upon whether the valve 262 is energized or not.

If the valve 262 is energized, thereby connecting the junction of the orifices 244 and 254 to tank, the orifice 254 will be effectively bypassed so that the only back pressure resisting movement of the rod 228 of the cylinder 230 will be provided by the orifice 244, although some fluid may flow through the orifice 254. As a result, back pressure will be at its relative minimum allowing a relatively rapid rate of movement of the rod 228. This action provides for fast infeed of the grinding element. Once the grinding element has been moved sufficiently close to the work, the valve 262 may be deenergized to cut off the bypass defined by line 260, at which time fluid from the port 234 must flow through the serial combination of the orifices 244 and 254 thereby elevating the back pressure and decreasing the rate of movement of the rod 228. This, in return, provides a fine infeed of the grinding element.

Control of the valves 240 and 262 may be achieved through the use of dogs 270 and 272 on an end of the rod 228 opposite from the track 226 operating limit switches 274, 276 and 278.

The switches 274–278 are employed in suitable electric circuitry to control infeed and outfeed of the grinder. For example, the switch 278 may be of the type having two stable conditions and is provided with two actuators as schematically illustrated in FIG. 2 responsive to movement of the dog 272 to the right or to the left for infeed and outfeed, respectively. The switch 278 will thus be tripped at the initiation of an infeed operation and will be returned to is initial condition at the conclusion of an outfeed operation.

The switch 274 is arranged to cooperate with the dog 270 and is the same type of switch as the switch 278. When it is tripped by the dog 270, it is employed to signal the end of the rapid feed condition and the start of the fine infeed and, accordingly, is appropriately electrically connected to the solenoid-operated valve 262.

The switch 276 is arranged to be tripped by the dog 270 when fine infeed is to be terminated to initiate the spark-out process. It, accordingly, is appropriately electrically connected to any suitable valve (not shown) in the control circuit for the cylinder 230 to halt the flow of fluid under pressure to the port 232 and, in addition, is electrically connected to the valve 118 to cause the same to open to increase the rate of rotation of the corresponding work table 14 for spark-out, as mentioned previously.

Figure 5:
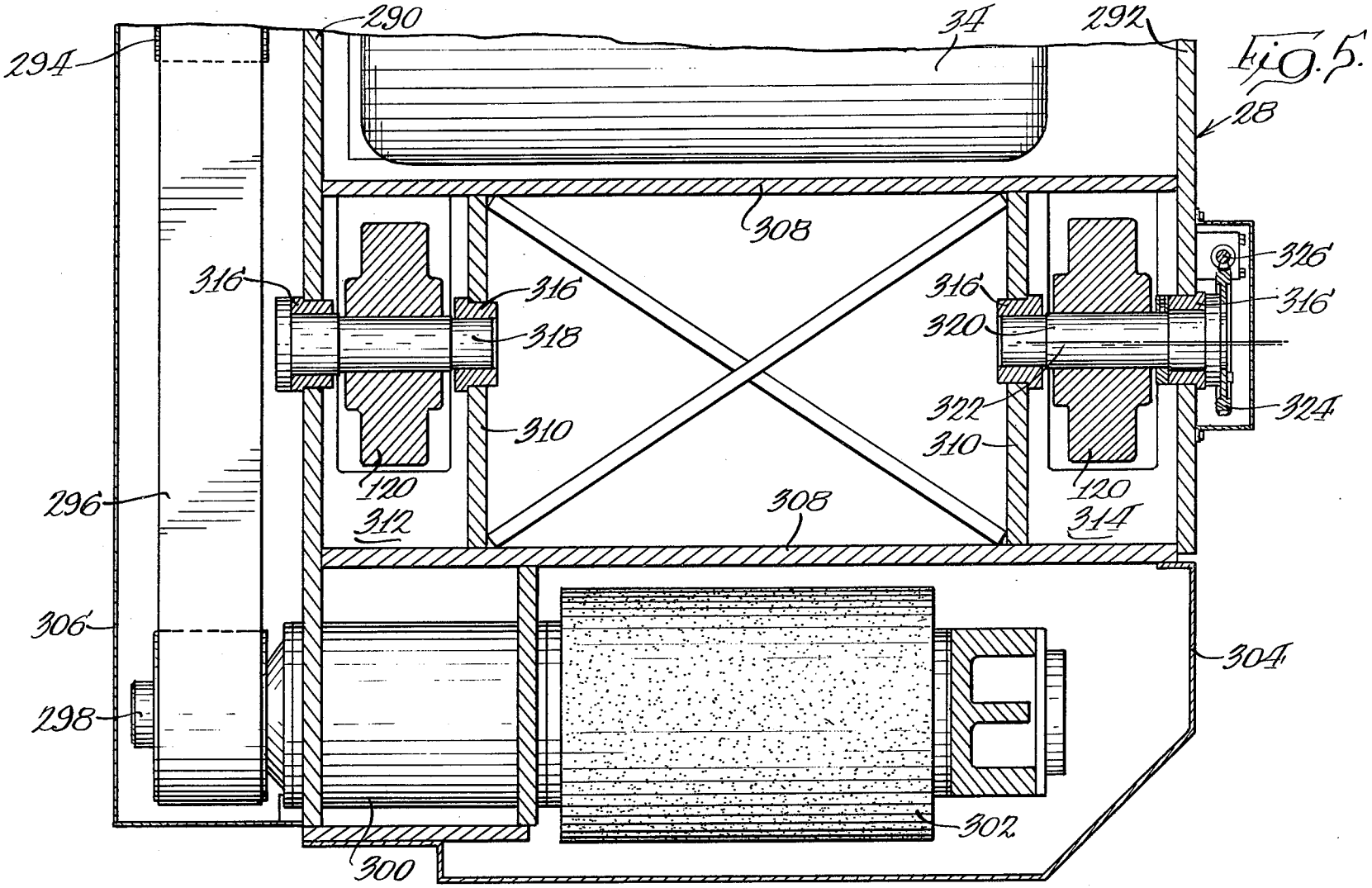
FIG. 5 is an enlarged, fragmentary sectional view of one of the columns and the grinding element housed therein.

Turning now to FIG. 5, other structural features of each column 28 will be described. Each column 28 includes a pair of side plates 290 and 292 which partially house the corresponding one of the drive motors 34 for the grinding element. Each drive motor 34 includes a sheave 294 on its output shaft and by means of a belt 296, rotary motion is conveyed to a sheave-bearing shaft 298 journalled in a bearing 300 and mounting an abrasive belt 302 on one end thereof. Depending upon whether the column is employed at the coarse grinding station 24 or the fine grinding station 26, the belt 302 will have either a coarse or fine abrasive thereon.

A safety housing 304 surrounds a portion of the grinding element defined by the belt 302 while a similar housing 306 contains the belt 296 and appurtenances.

Column 28 also includes laterally-extending mounting plates 308 along with transverse mounting plates 310 which define bearing-receiving housings 312 and 314, respectively. Suitable bearings 316 in the side plates 290 and 310 journal shafts 318 and 320. The shaft 318 is, in turn, received in one of the pillow block bearings 120, as mentioned previously. The shaft 320 is also received in a pillow block bearing 120 on the opposite side of the column 28. As a result, column 28 is mounted for pivotal movement on a substantially horizontal axis, as mentioned previously.

To obtain parallelism between the grinding belt 302 and the workpiece on the underlying table, the shaft 320 has an eccentric portion 322 intermediate its ends and within the pillow block bearing 120. In addition, an extension of the shaft 320 exterior of the side plate 292 mounts a gear 324 which is engaged with a worm gear 326. The latter, in turn, is provided with any suitable handle, such as a hand wheel. As a result of the foregoing construction, it will be appreciated that rotation of the worm gear 326 will result in rotation of the eccentric portion 322 of the shaft 320 to cant one side of the column 28 relative to the other. By suitably selecting a position of adjustment of the eccentric portion 322, exact parallelism between the belt 302 and the underlying workpiece may be achieved.

From the foregoing, it will be recognized that a grinding apparatus made according to the invention permits correlation of the feed rate of the grinding element, and the speed of oscillation of the index table whereby the workpiece will have an improved finish because of minimizing of the scratch pattern. The same features provide improved grinding element life because of the varying area of cut and improved flatness of the grinding surface of the workpiece because of a relatively random cutting pattern. Depending upon the specific grinding operation to be performed, the width of the belt may be varied although the same should be at least wide enough to extend beyond the center and the outer periphery of the workpiece. While the work tables 14 herein have been described as fully rotatable, if desired, they may be constructed to provide a lesser degree of rotation but should have at least 109° of rotation.

It will thus be appreciated that a grinding apparatus made according to the invention provides a vastly superior structure compared to those heretofore known, including a plurality of built-in safety features, wear minimizing features, adjustment features and, most importantly, features which improve the efficiency of a grinding operation.

We claim:

1. A grinding machine including a rotatable index table, a plurality of rotatable work tables on the index table, grinding means at a station adjacent said index table, said grinding means including a column carrying a grinding element, pivot means mounting the column for pivotal movement to move the grinding element toward and away from a work table, and selectively operable means acting on the column for causing movement thereof including a jack mechanism having a vertical screw, a rack and gear drive for rotating the screw, a hydraulic cylinder for moving said rack, and a hydraulic circuit for said cylinder including valve means operative to advance said rack at either a first rate for rapid infeed of the grinding element toward the work table or at a second rate for fine infeed of the grinding element.

2. A grinding machine as defined in claim 1 including a splined connection of the rack and gear drive to the vertical screw, a net coacting with the vertial screw, and means for rotating said nut while the vertical screw is held against rotation by the rack and gear drive to vertically adjust the position of said vertical screw.

3. A grinding machine as defied in claim 1 wherein the weight of said column is unbalanced to one side of the pivot means whereby said column is urged by gravity toward said jack mechanism.

4. A grinding machine as defined in claim 1 including means acting on the column urging the column about the pivot means in a direction to urge the column toward said jack mechanism.

5. A grinding machine having a base, an index table rotatably mounted on said base, three work tables rotatably mounted on the index table for rotation relative thereto, three stations adjacent said index table with two of the stations being grinding stations with means for grinding and one station providing for loading and unloading of a work table, means for rotating said index table to bring two of said work tables to the two grinding stations, means for oscillating the index table to oscillate the work tables relaive to the grinding means in a grinding cycle and means for simultaneously rotating the work tables at the grinding stations in a grinding cycle in a single direction regardless of the direction of travel of the index table, and said means for oscillation of the index table including a pair of spaced limit switches at the loading and unloading station and a plurality of pairs of dogs on the index table with one pair associated with each work table for operating said spaced limit switches when at said one station, and a single trip dog on the index table and associated with one work table and coacting with a plurality of home limit switches with one of said home limit switches at each of said stations whereby said single trip dog in tripping one of the home limit switches functions to identify which work table is at each of the stations.

6. A grinding machine having a base, an index table rotatably mounted on said base, a plurality of spaced work tables rotatably mounted on the index table for rotation relative thereto, a grinding station having means for grinding a workpiece including a grinding element, means for rotating said index table to bring successive work tables to the grinding station, means providing relative oscillatory movement between the work table and the grinding means in a grinding cycle and means for simultaneously rotating a work table at the grinding station in a grinding cycle, said grinding means including a column mounting the grinding element, means mounting said column for pivotal movement for movement of the grinding element relatively toward and away from a work table disposed therebetween, said pivot being located whereby the weight of the column is unbalanced to one side of the pivot tending to pivot the column in a direction to move the grinding element away from the work table, and including means acting on the column urging the column about the pivot in a direction to move the grinding element away from the work table.

7. A grinding machine as defined in claim 6 wherein said means acting on the column is a hydraulic cylinder with said cylinder being in constant communication with a source of hydraulic fluid under pressure.

8. A grinding machine having a base, an index table rotatably mounted on said base, a plurality of spaced work tables rotatably mounted on the index table for rotation relative thereto, a grinding station having means for grinding a workpiece including a grinding element, means for rotating said index table to bring successive work tables to the grinding station, means providing relative oscillatory movement between the work table and the grinding means in a grinding cycle and means for simultaneously rotating a work table at the grinding station in a grinding cycle, said grinding means including a column mounting the grinding element, means mounting said column for pivotal movement for movement of the grinding element relatively toward and away from a work table disposed therebeneath, said pivot being located whereby the weight of the column is unbalanced to one side of the pivot tending to pivot the column in a direction to move the grinding element away from the work table, means acting on the column urging the column about said pivot in a direction to move the grinding element away from the work table, and including selectively operable means acting on the column to move the column about said pivot and against the urging means in a direction to move the grinding element toward the work table, said selectively operable means including means for adjusting the rotative position of the column relative to the pivot and additional means providing for infeed and fine infeed of the column and grinding means.

9. A grinding machine as defined in claim 8 wherein said additional means providing for infeed of the column includes a rack and gear drive and a hydraulic cylinder for moving the rack and a hydraulic control circuit for varying the rates of fluid flow to the cylinder.

10. A grinding machine as defined in claim 8 wherein said selectively operable means includes a movable plunger and means holding said plunger extended but rendered ineffective upon malfunctioning of the grinding means.

11. A grinding machine having a base, an index table rotatably mounted on said base, a plurality of spaced work tables rotatably mounted on the index table for rotation relative thereto, a grinding station having means for grinding a workpiece including a grinding element, means for rotating said index table to bring successive work tables to the grinding station, means providing relative translatory movement between the work table and the grinding means in a grinding cycle and means for simultaneously rotating a work table at the grinding station in a grinding cycle, said grinding means including a column mounting the grinding element, means mounting said column for pivotal movement for movement of the grinding element relatively toward and away from a work table disposed therebeneath, said pivotal mounting means for the column including a pair of spaced bearings on the base, a pair of pivot shafts in said bearings and connected to said column, one of said pivot shafts being eccentric, and means on the column for rotating said eccentric shaft relative to the column for canting of the column to obtain parallelism of the grinding means relative to a work table.

12. A grinding machine having a base, an index table rotatably mounted on said base, three work tables rotatably mounted on the index table, three stations adjacent said index table with two of the stations being grinding stations having means for grinding a workpiece and one station providing for loading and unloading of a work table, means for oscillating said index table to move a work table back and forth relative to the grinding element, motor means carried by the index table for simultaneously rotating the last-mentioned work table, and means for simultaneously moving the column and grinding element toward the work table, said means for oscillation of the index table including a pair of spaced limit switches at the loading and unloading station and a plurality of pairs of dogs on the index table with one pair associated with each work table for operating said spaced limit switches when at said one station and a single trip dog on the index table and associated with one work table and coacting with a plurality of home limit switches with one of said home limit switches at each of said stations whereby said single trip dog in tripping one of the home limit switches functions to identify which work table is at each of the stations.

13. A grinding machine as defined in claim 12 wherein the means for moving the column includes a hydraulic cylinder having a piston rod and limit switches for detecting the position of the piston rod and thereby the position of the grinding element.

14. A grinding machine having a base, a work table movably mounted on said base, and a grinding station having means for grinding a workpiece including a grinding element, said grinding means including a column mounting the grinding element, means mounting said column for pivotal movement for movement of the grinding element relatively toward and away from a work table disposed therebeneath, said pivotal mounting means for the column including a pair of spaced bearings on the base, a pair of pivot shafts in said bearings and connected to said column, one of said pivot shafts being eccentric, and means on the column for rotating said eccentric shaft relative to the column for canting of the column to obtain parallelism of the grinding means relative to a work table.

* * * * *